US005154536A

United States Patent [19]

Ciudaj

[11] Patent Number: 5,154,536

[45] Date of Patent: Oct. 13, 1992

[54] ADJUSTABLE SCREED RAIL

[76] Inventor: Jeffrey Ciudaj, 555 S. White Cottage Rd., Angwin, Calif. 94508

[21] Appl. No.: 708,286

[22] Filed: May 31, 1991

[51] Int. Cl.[5] ..... E01C 19/12

[52] U.S. Cl. ..... 404/118; 52/365

[58] Field of Search ..... 52/364, 365, 367; 404/117, 118

[56] References Cited

U.S. PATENT DOCUMENTS

| | | | |
|---|---|---|---|
| 1,977,076 | 10/1934 | Mann | 52/367 X |
| 2,025,576 | 12/1935 | De Spirt | 52/365 |
| 2,197,278 | 4/1940 | Sverdahl | 52/365 X |
| 3,333,380 | 8/1967 | Wolf | 52/365 |
| 4,371,330 | 2/1983 | Heffernan | 404/118 X |
| 4,752,156 | 6/1988 | Owens | 404/118 |
| 4,909,002 | 3/1990 | Clifton et al. | 52/364 X |
| 4,945,698 | 8/1990 | Jertberg et al. | 52/365 |

OTHER PUBLICATIONS

"Handbook for Ceramic Tile Installation", 1990, Tile Council of America, Methods F101-90, F102-90, F103-90, F111-90, F112-90, F113-90.

*Primary Examiner*—William P. Neuder
*Attorney, Agent, or Firm*—Richard C. Litman

[57] ABSTRACT

Disclosed is an adjustable screed rail or guide comprising a top T-shaped element and an inverted lower T-shaped element which cooperate to form an adjustable elongated I-beam. The top T-shaped element and the lower T-shaped element are respectively formed of a flange element and at least one web element centrally located and perpendicular to the respective flange element. The lower T-shaped element has a second web element spaced from said at least one web element, the web element of the top T-shaped element being slidably located between the two lower web elements to adjust the height of the screed surface. The screed rail is locked in the adjusted position by bolts and wing nuts. The upper and lower flanges are provided with depending lips which serve the purpose of retaining poured cement or mortar against the screed rail, the screed rail providing reinforcement for the cement or mortar bed. The depending webs also have openings through which cement, mortar and/or reinforcing rods may be passed. The top T-shaped element is provided with a second depending web element parallel to the one centrally located web element, the bottom edge of the second web element being engageable with the top edge of one of the two lower web elements to provide a minimum-thickness gauge whereby a poured concrete or mortar bed will meet minimum code requirements for thickness.

5 Claims, 2 Drawing Sheets

FIG. 1
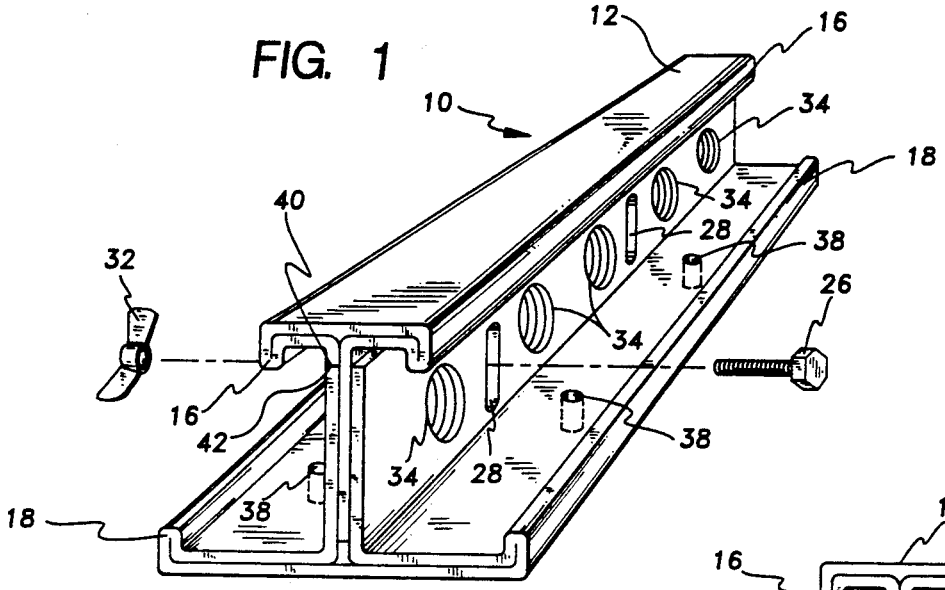
FIG. 2
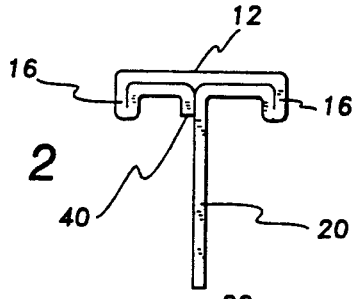
FIG. 4
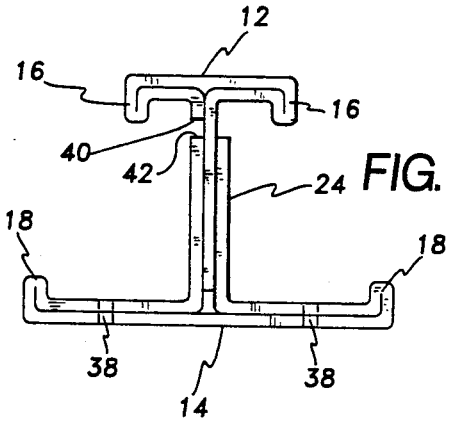
FIG. 3
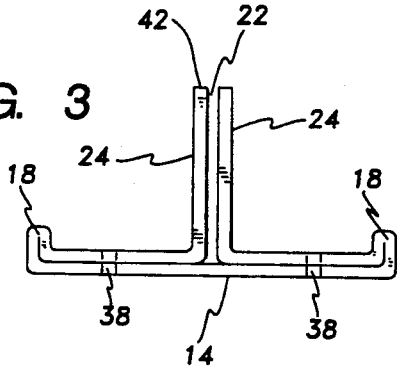
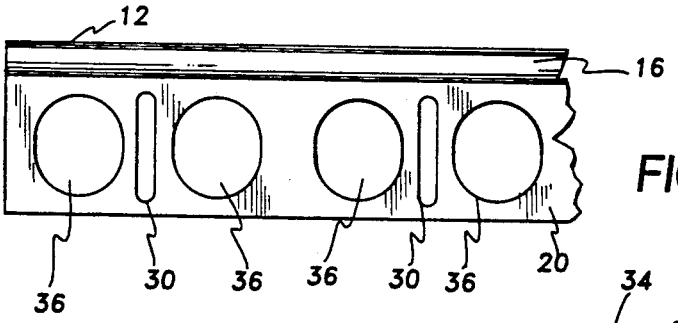
FIG. 5
FIG. 6
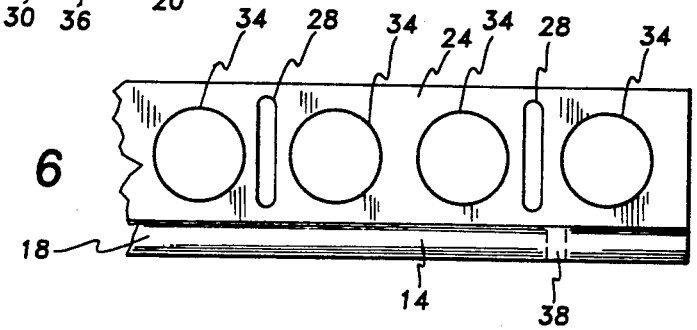

ADJUSTABLE SCREED RAIL

BACKGROUND OF THE INVENTION

1. Field of the Invention

This invention relates to an adjustable concrete or mortar screed rail for guiding a screed for the purpose of leveling the poured concrete or mortar to a desired height so as to control the thickness of the concrete or mortar to be applied. This device then becomes a metal reinforcement of the concrete or mortar bed.

In the past, the process of laying concrete or mortar has involved dividing the floor into rectangles of equal size. Half of these rectangles, distributed in a chessboard pattern, are laid the first day and the remaining half are laid the second day, since the sides bounding these rectangles are used as a screed guide support for the apparatus which is used for leveling the applied concrete or mortar. Every second section must be given sufficient time to harden before the adjacent sections can be treated in the same way. The arrangement-forming boundaries for the sides of the rectangular sections also act as barriers for the freely running concrete or mortar.

Conventionally, sand is often used as a base on which screed guide supports can be placed so that they are horizontal. When the screed guides are in position, concreting can be carried out in the first-day rectangles. The concrete is poured in the rectangles in question and is leveled off manually. When all the first-day rectangles have been processed, work is stopped to give the concrete time to harden until the next day. The same screed guide supports can be used on the following day for proceeding in an analogous manner.

As shown in FIG. 8, most tile contractors currently use a wood float strip application which involves setting a 1½ inch by ⅛-inch wood strip 46 on a previously applied row of mortar 48. Wood strip 46 is pressed into place and leveled to a height of 1¼ inch above plywood subfloor 50 while mortar row 48 is still soft. Thereafter, mortar 52 is poured to a height of 1¼ inches, the poured mortar 52 forming a cold joint 54 with the previously-applied mortar row 48. Some of the problems involved with wood float strip application include the fact that the cold joints 54 almost always crack with ease, it is difficult to keep edges of the wood 46 level, and the process takes 4–5 times longer than when using the adjustable screed rail of the invention.

2. Description of Related Prior Art

Screed guides, including adjustable screed guides, are known in the prior art. U.S. Pat. No. 4,598,517 issued Jul. 8, 1986 to Yngve Alvarsson discloses a unitary screed guide having upper and lower flanges for the purpose of resting flatly on a base, the web joining the flanges having openings therein to allow the passage therethrough of reinforcing rods. Also disclosed therein are ring-shaped screed guides to surround ceiling support pillars. The disclosed screed guides are not individually adjustable other than by changing the level of the base supporting the screed guides.

U S. Pat. No. 4,707,955 issued Nov. 24, 1987 to John D. Clapson discloses a variety of unitary screed rails which are adjusted vertically by means of spacers. U.S. Pat. No. 4,727,690 issued Mar. 1, 1988 to Keith Honeyman discloses a unitary screed rail designed to rest on an underlying surface which may be formed by bare soil or concrete. U.S. Pat. No. 4,884,384 issued Dec. 5, 1989 to Stig-Ake Ljungkvist and Lennart Johansson discloses a unitary screed guide or rail formed as an I-beam, vertical adjustment being provided in the form of sand U.S. Pat. No. 4,909,002 issued Mar. 20, 1990 to Roy A. Clifton and Terry J. Stoner discloses unitary screed rails of various shapes formed of concrete.

U.S Pat. No. 4,945,698 issued Aug. 7, 1990 to Jeffrey R. Jertberg et al. discloses an adjustable screed guide or rail formed of two elements which are adjustable relative to one another. The screed guide or rail, while disclosed to be used during screeding of cement on a wall, may be used in the formation of floors. The screed rail or guide is formed of an angled bar which is attached by wood screws to a wall or subflooring, and a flat bar which is adjustably mounted on the angled bar by bolts and nuts, the flat bar having a flat edge upon which a screed rides, and holes through which strengthening wires and/or concrete or mortar may be passed.

SUMMARY AND OBJECTS OF THE INVENTION

It is an object of this invention to provide an adjustable screed guide or rail to enable a level surface to screed from.

It is a further object of this invention to provide an adjustable screed guide or rail configured to lock a concrete or mortar bed to both sides of the screed guide or rail, thereby providing increased stability of the concrete or mortar bed.

These and other objects are achieved by providing a screed guide or rail formed of hardened, folded metal comprising two parts, a top "T" shape and a bottom inverted "T" shape, the top "T" fitting into the lower inverted "T", thereby forming an elongated wide-based I-beam. The screed guide or rail is attached to a subfloor panel where mortar or cement will be laid. The screed guide or rail can then be adjusted as to height by sliding the top piece up or down to create a level surface to screed from. Once the surface is made level the two parts may be bolted together through elongated slots to maintain precision. Mortar or cement is then poured around the screed guide or rail, which becomes a metal reinforcement of the cement or mortar. The lips provided on the top and bottom flanges formed by the tops of the respective "T"s are significant in that they lock the cement or mortar bed to both sides of the screed guide or rail. Also, the top flange is significantly narrower than the bottom flange to enable the user to easily secure the screed guide or rail to the subflooring or to a wall.

By bending the metal to form the "T"s for the adjustable screed rail a double thickness is achieved. This, along with the shape of the "I" beam when the male and female "T"s are joined, produces maximum rigidity and strength for the entire unit, thus producing a precision screed rail that stands up to extreme field conditions.

Other objects, features and advantages of this invention will become apparent from the following detailed description and the appended claims, reference being had to the accompanying drawings forming a part of the specification, wherein like reference numerals designate corresponding parts of the several views.

BRIEF DESCRIPTION OF THE DRAWINGS

FIG. 1 is a perspective view of the screed guide or rail showing how the top and bottom T-shaped elements of the screed guide or rail cooperate.

FIG. 2 is an end view of the screed guide or rail showing the top T-shaped male element of the screed guide or rail.

FIG. 3 is an end view of the screed guide or rail showing the inverted bottom T-shaped female element of the screed guide or rail.

FIG. 4 is an end view of the screed guide or rail showing the top T-shaped male element of the screed guide or rail raised relative to the inverted bottom T-shaped female element of the screed guide or rail.

FIG. 5 is a side view of the screed guide or rail showing the top T-shaped male element of the screed guide or rail.

FIG. 6 is a side view of the screed guide or rail showing the inverted bottom T-shaped female element of the screed guide or rail.

DETAILED DESCRIPTION OF THE PREFERRED EMBODIMENT

Figure 7:
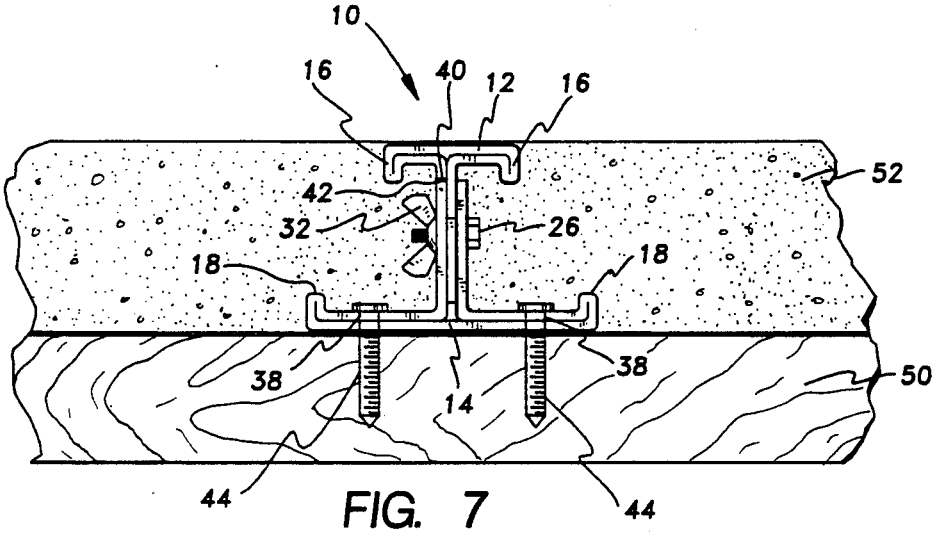
FIG. 7 is a cross-sectional end view showing the adjustable screed rail attached to a plywood subfloor.
Figure 8:
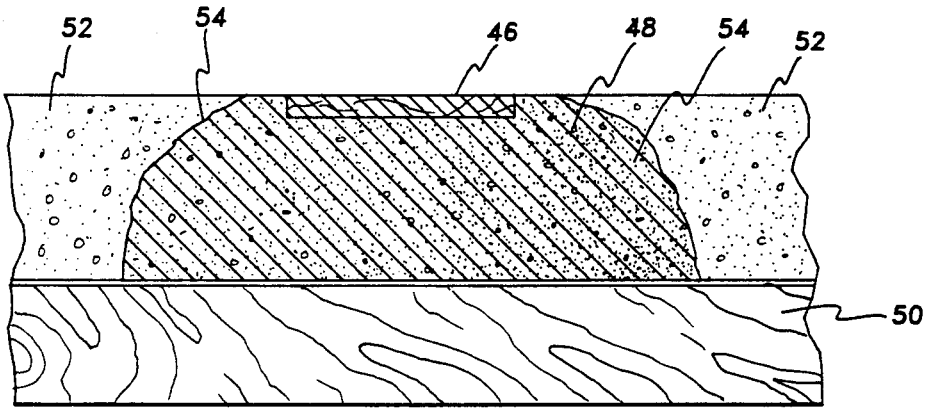
FIG. 8 (PRIOR ART)
FIG. 8 is a cross-sectional view showing the prior art method used by tile contractors for pouring mortar to a minimum height.

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

The screed guide or rail is identified in its entirety by reference numeral 10 in FIG. 1. Screed guide or rail 10 is made of hardened metal bent to form a top T-shaped male element 12 and an inverted bottom T-shaped female element 14. The tops of the respective T-elements 12 and 14 form a flanged I-beam when the T-elements 12 and 14 are mated. The top flange and the bottom flange of T-elements 12 and 14 have lips 16 and 18, respectively, formed thereon for a purpose described below.

The web 20 of top T-element 12 is designed to be slidably adjustable in the opening 22 provided by the two webs 24 of the bottom T-element 14. Once the desired height adjustment is achieved, the T-elements 12 and 14 are locked together by means of bolts 26 which enter elongated vertical slots 28 in webs 24 and slots 30 in web 20, and winged nuts 32. The purpose of using a wing nut 32 with bolt 26 is to allow the installer to quickly tighten wing nut 32 on bolt 26 by hand as the installer levels the top of T-element 12. Webs 24 have holes or openings 34 which cooperate with holes or openings 36 in web 24, for the purpose of permitting cement or mortar 52 to flow therethrough. Such holes or openings 34 and 36 may also be used to pass reinforcing wires therethrough. The lips 16 and 18 serve to prevent the cement or mortar 52 from pulling away from webs 20 and 24 during drying or curing of the cement or mortar 52.

In many states, there are building codes applying to mortar thickness to ensure a minimum standard of acceptability. The minimum thickness allowed for a poured mortar floor in most areas is 1¼ inches. Edge 40 of the metal forming T-element 12 cooperating with edge 42 of the metal forming T-element 14 form a minimum thickness gauge when T-element 12 is at its lowest level relative to T-element 14, as shown in FIG. 1. Accordingly, if the minimum height of the I-beam formation is 1¼th inch the minimum-thickness gauge formed by edges 40 and 42 prevents the adjustable screed rail 10 from being set at a level that would produce a mortar bed that does not meet the minimum code requirements of 1¼th inch. Thus, if used correctly, the use of the adjustable screed rail 10 would assure compliance with 1¼th inch codes.

In use, screed guide or rail 10 is attached to a subflooring 50 or a wall by means of screws 44 which pass through screw holes 38 in T-element 14. Thereafter, screed guide or rail 10 is adjusted by sliding element 12 up or down relative to element 14 to create a level or plumb surface to be screed from. Once the screed guide or rail 10 is made level, elements 12 and 14 are bolted together through holes or openings 28 and 30 by bolts 26 and wing nuts 32. Mortar 52 or cement is then poured around screed guide or rail 10 which becomes a metal reinforcement of the mortar or cement bed. Tiles may then be laid on top of the poured mortar or cement.

Figure 9:
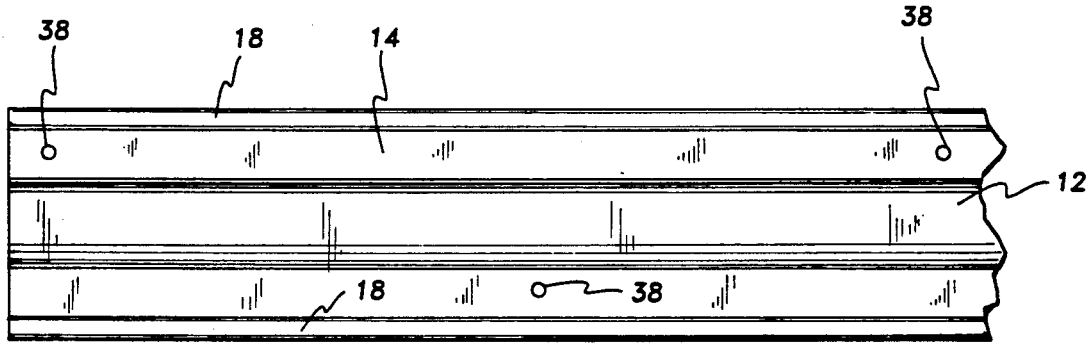
FIG. 9 is a top view of the adjustable screed rail.

Dimensionally, with reference to the preferred embodiment, element 12 is approximately ¾th-inch wide at the top flange, and approximately 13/16th inch high. Element 14 is 2 inches wide at the base flange, and 1 inch high. Lips 16 and 18 are approximately ¼th-inch high. As shown in FIG. 9, in the preferred embodiment, screw holes 38 are placed every 8 inches on each side of the bottom flange of T-element 14. There is a 4-inch offset from one side to the other, allowing screws 44 to fall on a 16-inch O.C. layout of wall studs or floor joists. It also allows a screw hole 38 to be within 4 inches of the end of screed guide or rail 10 no matter what length rail 10 is cut to. The distance between centers of screw holes 38, as shown in FIG. 3, is 1¼th inch. The holes 36 in web 20 are elongated, with the long axis being ¾th inch and the short axis being ⅝th inch. Slots 28 and 30 are approximately ⅛th-inch wide. Holes or openings 34 in web 24 are circular with a ⅝th-inch diameter.

The advantages of the adjustable screed rail 10 include the elimination of cold joints and the elimination of cracks by the screed rail. Also, the mortar 52 or cement may be mixed once, and the entire job may be poured at one time, thereby cutting work time by 75 to 80 percent.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. An adjustable screed rail comprising:

a top T-shaped means including a flat, elongated upper flange means having downwardly depending, longitudinally extending first lip means along each side of said upper flange means, and a centrally located, longitudinally extending, downwardly depending web means having first slot means extending in a direction perpendicular to said upper flange means;

an inverted bottom T-shaped means including a flat, elongated lower flange means having upwardly extending second lip means along each side of said lower flange means, and a pair of spaced centrally located, longitudinally extending upwardly directed web means having second slot means corresponding to said first slot means extending in a direction perpendicular to said lower flange means;

said downwardly depending web means being slidably located between said pair of upwardly directed web means to form an adjustable I-beam configuration; and locking means to maintain the relative adjusted position of said top T-shaped means and said inverted bottom T-shaped means; whereby;

said screed rail provides a level surface to screed from when cement or mortar is poured, said first and second lip means tending to hold the cement or mortar against separation from said screed rail while drying.

2. An adjustable screed rail as in claim 1, further comprising:

a set of oblong hole means in said downwardly depending web means of said top T-shaped means; and a set of circular hole means in each of said pair of spaced upwardly directed web means corresponding to said set of oblong hole means; whereby said oblong hole means and said circular hole means enable said poured concrete or mortar to pass through from one side of said screed rail to the other side of said screed rail, and reinforcing rod means may be passed through said respective hole means to reinforce said poured concrete or mortar.

3. An adjustable screed rail as in claim 2, wherein:

said top and bottom T-shaped means are formed of folded, hardened metal;

said lower flange means has spaced screw openings therein whereby said adjustable screed rail may be selectively attached to subflooring and walls; and said upper flange means is narrower than said lower flange means to provide access to said screw openings.

4. An adjustable screed rail as in claim 3, wherein:

said locking means comprises bolt means which pass through said first and second slots; and wing nut means to hold said bolt means in position to look said top T-shaped means and said lower T-shaped means together.

5. An adjustable screed rail as in claim 3, further comprising:

a second downwardly depending web means on said top T-shaped means parallel to said centrally located, longitudinally extending, downwardly depending web means;

a bottom edge of said second downwardly depending web means engageable with a top edge of one of said pair of spaced centrally located, longitudinally extending upwardly directed web means, thereby to provide a minimum-thickness gauge; whereby said adjustable screed rail will be set at a level which produces a concrete or mortar bed which meets minimum code requirements for thickness.

* * * * *